US011162449B2

(12) United States Patent
Yamada et al.

(10) Patent No.: US 11,162,449 B2
(45) Date of Patent: Nov. 2, 2021

(54) FUEL PRESSURE CONTROL DEVICE FOR INTERNAL COMBUSTION ENGINE

(71) Applicant: Honda Motor Co., Ltd., Tokyo (JP)

(72) Inventors: Masahiro Yamada, Saitama (JP); Hirofumi Ohara, Saitama (JP); Takayoshi Okuda, Saitama (JP); Toshifumi Hiraboshi, Saitama (JP); Yoichi Kanou, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/160,410

(22) Filed: Jan. 28, 2021

(65) Prior Publication Data

US 2021/0231079 A1 Jul. 29, 2021

(30) Foreign Application Priority Data

Jan. 29, 2020 (JP) ..... JP2020-012278

(51) Int. Cl.
*F02D 41/30* (2006.01)
*F02D 41/06* (2006.01)
*F02D 41/20* (2006.01)

(52) U.S. Cl.
CPC ..... *F02D 41/3082* (2013.01); *F02D 41/062* (2013.01); *F02D 41/20* (2013.01); *F02D 2041/2048* (2013.01); *F02D 2200/0602* (2013.01); *F02D 2200/101* (2013.01); *F02D 2250/31* (2013.01)

(58) Field of Classification Search
CPC .... F02D 41/3082; F02D 41/062; F02D 41/20; F02D 2200/0602; F02D 2200/101; F02D 2250/31; F02D 2041/2048
See application file for complete search history.

(56) References Cited

U.S. PATENT DOCUMENTS 4,669,429 A * 6/1987 Nishida ..... F02M 61/161 123/179.17
9,677,489 B2 * 6/2017 Schwarz ..... F02D 19/085
9,995,226 B2 * 6/2018 Suzuki ..... B60W 20/00
2009/0095259 A1 * 4/2009 Pursifull ..... F02M 59/447 123/457
2010/0031911 A1 * 2/2010 Gessier ..... F02N 11/0866 123/179.21
2011/0162622 A1 * 7/2011 Kojima ..... F02D 41/062 123/457
2021/0033043 A1 * 2/2021 Ishikawa ..... F02D 41/3863

FOREIGN PATENT DOCUMENTS

JP 2001295725 10/2001

* cited by examiner

*Primary Examiner* — Carl C Staubach
(74) *Attorney, Agent, or Firm* — JCIPRNET

(57) ABSTRACT

The invention is related to a fuel pressure control device for an internal combustion engine, which controls a pressure of fuel supplied to a fuel injection valve and includes: a fuel pump, adopting the internal combustion engine as a driving source, and discharging pressurized fuel to a side of the fuel injection valve; a boost control part, setting a fuel discharge amount of the high-pressure fuel pump to a maximum value for boosting a pressure from a time when cranking starts until a predetermined timing halfway during a startup of the internal combustion engine; and a limit control part, performing limit control which follows the boost control and limits the fuel discharge amount to an upper limit.

5 Claims, 5 Drawing Sheets

FUEL PRESSURE CONTROL DEVICE FOR INTERNAL COMBUSTION ENGINE

CROSS-REFERENCE TO RELATED APPLICATION

This application claims the priority benefit of Japan application serial no. 2020-012278, filed on Jan. 29, 2020. The entirety of the above-mentioned patent application is hereby incorporated by reference herein and made a part of this specification.

BACKGROUND

Technical Field

The invention relates to a fuel pressure control device for an internal combustion engine, which controls a pressure of fuel supplied to a combustion chamber of the internal combustion engine.

Description of Related Art

In general, an internal combustion engine of a type in which fuel is directly injected to a combustion chamber from a fuel injection valve is configured so that the fuel is pressurized and discharged by a high-pressure fuel pump and supplied to a delivery pipe on the fuel injection valve side. In such case, the pressure of the fuel (referred to as "fuel pressure" in the following) inside the delivery pipe is controlled to a target fuel pressure set so as to be able to inject the fuel against the pressure in the combustion chamber by adjusting the fuel discharge amount of the high-pressure fuel pump. In addition, when the internal combustion engine is started, in order to make the start-up (complete explosion) thereof as soon as possible, the fuel pressure is quickly increased toward the target fuel pressure by increasing the fuel discharge amount. Therefore, an overshoot may occur in which the fuel pressure significantly exceeds the target fuel pressure. In such case, there is a concern that the fuel pressure exceeds a relief valve opening pressure, a relief valve is opened, the fuel pressure drops significantly, and, as a result, the start-up ability deteriorates.

As a conventional fuel pressure control device intending to resolve such an issue, one that is disclosed in Patent Document 1, for example, is known. In the fuel pressure control device, a high-pressure fuel pump includes a spill control valve formed by a solenoid valve, and is configured so that the fuel discharge amount increases as the energization duty ratio of the spill control valve increases. Then, at the time when the internal combustion engine is started, the energization duty ratio of the spill control valve is limited to a predetermined upper limit smaller than 100%. Accordingly, by suppressing the rising of the fuel discharge amount and the fuel pressure, the overshoot of the fuel pressure is prevented.

Prior Art Document

[Patent Document]

[Patent Document 1]: Japanese Laid-Open No. 2001-295725

In the conventional fuel pressure control device, the overshoot of the fuel pressure at the time when the internal combustion engine is started can be prevented. However, since the rise of the fuel pressure is suppressed by suppressing the fuel discharge amount, it requires a longer time for the fuel pressure to reach the target fuel pressure. As a result, since the injection timing of the fuel from the fuel injection valve becomes late, the start-up of the internal combustion engine becomes late, and the favorable start-up ability cannot be ensured.

SUMMARY

An aspect of the invention provides a fuel pressure control device for an internal combustion engine. The fuel pressure control device controls a pressure PF of fuel ("fuel pressure PF" in the embodiment as well as the following) supplied to a fuel injection valve 4. The fuel pressure control device includes: a fuel pump (high-pressure fuel pump 20), adopting the internal combustion engine 3 as a driving source, and discharging pressurized fuel to a side of the fuel injection valve 4; a boost control part (ECU2, Steps 3 and 4 of FIG. 4), performing boost control of setting a fuel discharge amount QFP of the fuel pump to a predetermined value (maximum QMAX) for boosting the pressure of the fuel from a time when cranking starts until a predetermined timing halfway during a startup of the internal combustion engine 3; and a limit control part (ECU2, Steps 8 to 11), performing limit control following the boost control, wherein the limit control limits the fuel discharge amount QFP by using an upper limit QLMT smaller than the predetermined value.

According to an embodiment of the invention, a target fuel pressure (target fuel pressure PFCMD) is set as a target value of the pressure PF of the fuel necessary for injecting the fuel from the fuel injection valve 4. In addition, the fuel pressure control device further includes a fuel pressure detection part (fuel pressure sensor 41) which detects the pressure of the fuel. The predetermining timing is a timing at which the pressure of the fuel that is detected reaches a vicinity (threshold PFREF) of the target fuel pressure.

According to an embodiment of the invention, the pressure control device for the internal combustion engine further includes: a relief valve 18, opening at a time when the pressure PF of the fuel reaches a predetermined relief valve opening pressure PRF to release the pressure PF of the fuel; and an upper limit setting part (ECU, Step 9), setting the upper limit QLMT based on a relationship between the pressure PF of the fuel detected at the predetermined timing and the relief valve opening pressure PRF.

According to an embodiment of the invention, the pressure control device for the internal combustion engine further includes: a rotation speed detection part (crank angle sensor 42), detecting a rotation speed (engine rotation speed) NE of the internal combustion engine 3, wherein the limit control part ends the limit control (Step 12) at a time when the rotation speed NE of the internal combustion engine 3 that is detected reaches (Step 1: YES) a predetermined rotation speed (idle rotation speed NEIDL) or after a predetermined period from a time when the startup of the internal combustion engine 3 begins.

According to an embodiment of the invention, the pressure control device for the internal combustion engine further includes: a pressure state determination part (ECU2, Steps 6, 7), determining a state of the pressure of the fuel at a time when the startup of the internal combustion engine 3 begins. The limit control part performs the limit control under a condition that the pressure of the fuel is determined as being in a high state (Steps 6 to 8).

DESCRIPTION OF THE EMBODIMENTS

Figure 1:
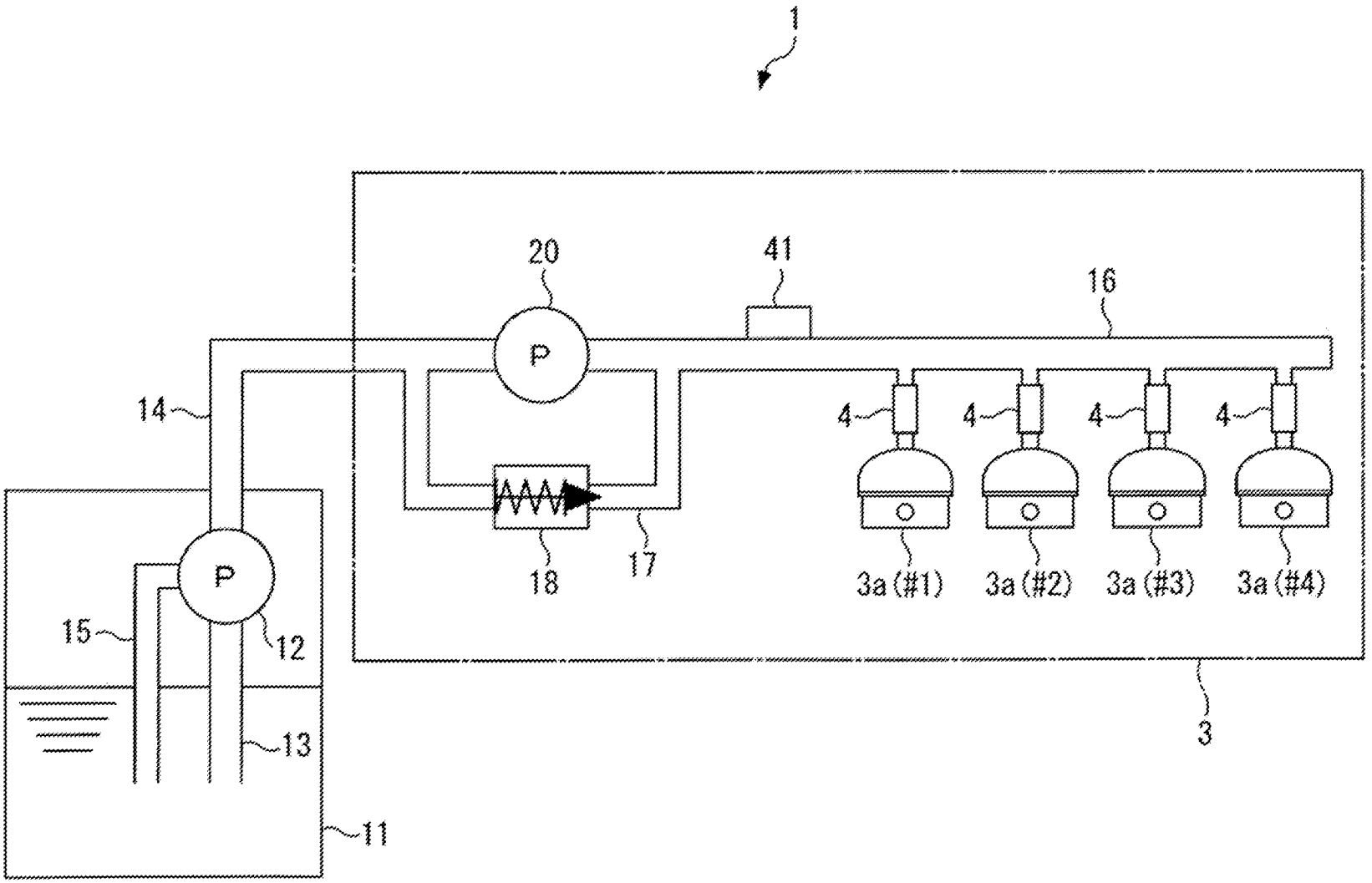
FIG. 1 is a schematic view illustrating a fuel supply device of an internal combustion engine suitable for the invention.

The invention provides a fuel pressure control device for an internal combustion engine capable of avoiding the overshoot of the pressure of the fuel at the time when the internal combustion engine starts, and accelerating the start-up of the internal combustion engine, so as to ensure favorable start-up ability.

In the fuel pressure control device, the fuel pump adopting the internal combustion engine as the driving source pressurizes the fuel and discharge the pressurized fuel to the fuel injection valve side. During the startup of the internal combustion engine, by performing the boost control, the fuel discharge amount of the fuel pump is set to be the predetermined value for boosting the pressure from the time when cranking starts until a predetermined timing halfway. Accordingly, the pressure of the fuel rises quickly, and eventually reaches the target value necessary for fuel injection from the fuel injection valve at an early stage. As a result, the injection timing of the fuel is advanced, and the startup of the engine (complete explosion) can thus be accelerated.

In addition, by performing the limit control following the boost control, the fuel discharge amount is limited to the upper limit smaller than the predetermined value in the case of the boost control. Therefore, after the boost control the fuel pressure rises slowly and does not significantly exceed the target value. Consequently, the overshoot of the fuel pressure at the time of startup can be prevented. Together with the acceleration of the internal combustion engine, a favorable startup ability can be ensured.

According to the configuration, the target fuel pressure is set as the target value of the pressure of the fuel necessary for injecting the fuel from the fuel injection valve. The boost control is performed until the detected fuel pressure reaches the vicinity of the target fuel pressure. Then, the limit control is performed. Accordingly, at a suitable timing responsive to the relationship between the actual fuel pressure and the target fuel pressure, the switching between the boost control and the limit control can be carried out. Therefore, the acceleration of the startup of the internal combustion engine and the prevention of the overshoot of the fuel pressure, which are the effects of claim 1, can be realized in a balanced manner.

According to the configuration, the upper limit limiting the fuel discharge amount in the limit control is set based on the relationship between the detected fuel pressure and the relief valve opening pressure. In addition, since the fuel pressure detected at the predetermined timing is used as the fuel pressure, the upper limit can be appropriately set, such as making the fuel pressure not exceed the relief valve opening pressure, while the actual fuel pressure at the time of proceeding to the limit control is reflected. Accordingly, in the limit control, the limitation on the fuel discharge amount can be appropriately carried out.

Since the internal combustion engine is started at the time when the rotation speed of the internal combustion engine reaches the predetermined rotation speed, it is estimated that the fuel has been injected from the fuel injection valve and the concern of the overshoot of the fuel pressure does not arise. In addition, after the predetermined time from the time when the startup of the internal combustion engine begins, it is similarly estimated that the fuel has been injected, and the concern of the overshoot of the fuel pressure does not arise. According to the configuration, when one of the two conditions is met, the limit control is ended. Therefore, the unnecessary suppression on the fuel pressure can be avoided.

At the time when the startup of the internal combustion engine begins, in the state in which the fuel pressure is high, the pressure difference with respect to the target value is relatively small. Therefore, an overshoot is prone to occurring. According to the configuration, with the state in which the pressure of the fuel is high as the condition, the limit control can be effectively performed only under the condition in which an overshoot is prone to occurring.

Figure 2:
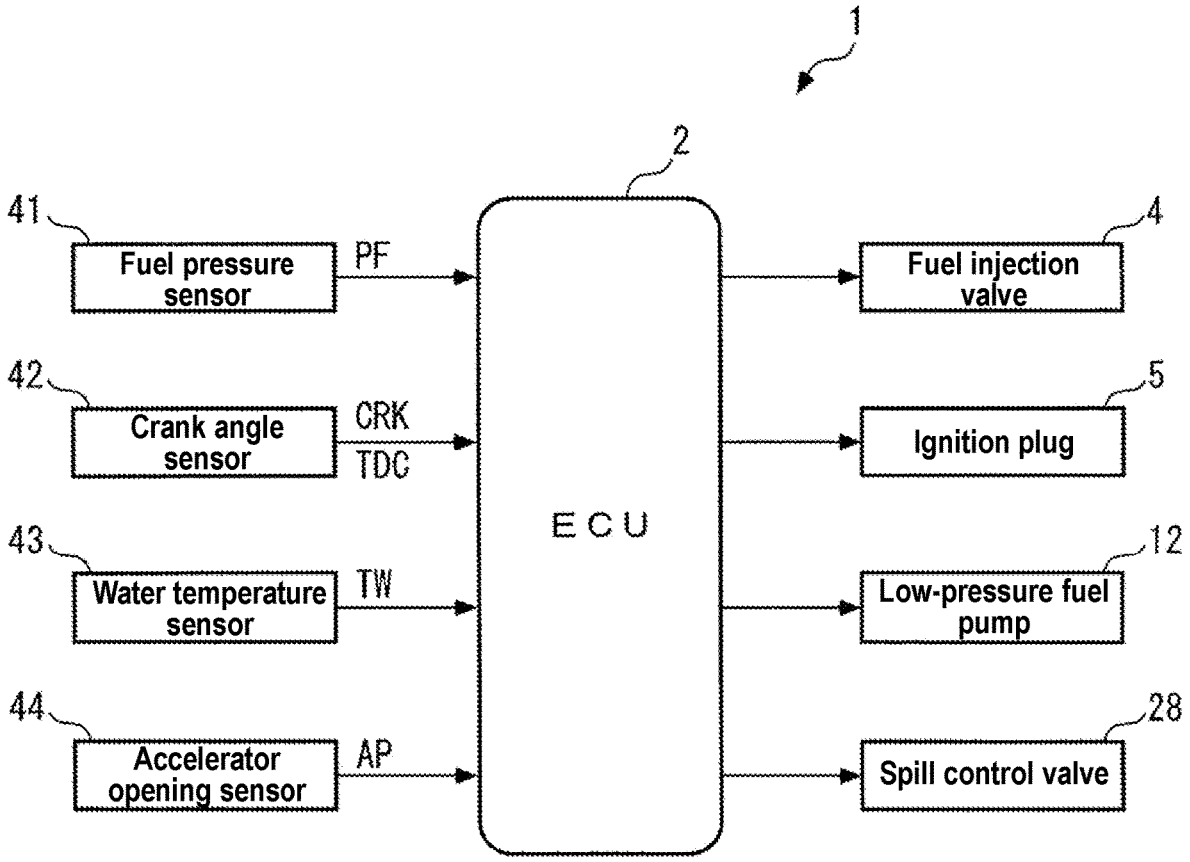
FIG. 2 is block diagram illustrating a fuel pressure control device as well as an input/output device thereof.

Hereinafter, the exemplary embodiments of the invention will be described in detail with reference to the drawings. An internal combustion engine (referred to as "engine" in the following) shown in FIG. 1 is, for example, a gasoline engine for a vehicle (not shown) and has four cylinders 3*a* (#1 to #4). In the engine 3, each cylinder 3*a* is provided with a fuel injection valve (referred to as "injector" in the following) 4 and an ignition plug 5 (as shown in FIG. 2), and a fuel supply device 1 which supplies fuel is provided for each injector 4.

The engine 3 is an engine of an in-cylinder injection type in which fuel is directly injected from the injector 4 to the cylinder 3*a*, and a gas mixture generated in the cylinder 3*a* is ignited by the ignition plug 5. The opening and closing of the injector 4 is controlled by a control signal from an ECU 2 (as shown in FIG. 2) to be described afterwards. Accordingly, the fuel injection period is controlled in response to the valve-opening timing, and the fuel injection amount is controlled by the valve opening time. In such case, the fuel injection period of the injector 4 is controlled to be a predetermined timing during a period from the intake stroke to the compression stroke. In FIG. 2, for the ease of illustration, only one injector 4 and one ignition plug 5 are shown as the representatives.

The fuel supply device 1 includes a fuel tank 11 for storing fuel, a low-pressure fuel pump 12 disposed in the fuel tank 11, and a high-pressure fuel pump 20.

The low-pressure pump 12 is an electric pump controlled by the ECU2 and is constantly driven during the operation of the engine 3. A fuel suction path 13, a low-pressure fuel passage 14, and a fuel return path 15 are connected with the low-pressure fuel pump 12.

The low-pressure fuel pump 12 sucks the fuel in the fuel tank 11 via the fuel suction path 13, increases the pressure to a predetermined low-pressure feed pressure, and discharges the fuel to the low-pressure fuel passage 14. Extra fuel of the low-pressure fuel pump 12 is returned to the fuel tank 11 via the fuel return path 15. In addition, the high-pressure fuel pump 20 is connected with a downstream end of the low-pressure fuel passage 14, and the low-pressure fuel discharged from the low-pressure fuel pump 12 to the low-pressure fuel passage 14 is supplied to the high-pressure fuel pump 20.

The high-pressure fuel pump 20 adopts the engine 3 as the driving source, is driven by the power thereof, and is connected with the delivery pipe 16. The high-pressure fuel pump 20 further pressurizes the low-pressure fuel supplied from the low-pressure fuel pump 12 and discharges the pressurized fuel to the delivery pipe 16. The configuration and the operation of the high-pressure fuel pump 20 will be described in detail in the following.

The four injectors 4 are disposed in parallel in the delivery pipe 16. The high-pressure fuel discharged from the high-pressure fuel pump 20 to the delivery pipe 16 is supplied to each of the injectors 4 and is injected into the corresponding cylinder 3*a* when the injector 4 is opened. In addition, in the delivery pipe 16, a fuel pressure sensor 41 for detecting a pressure PF of the fuel therein (referred to as "fuel pressure" in the following) is disposed, and a detection signal of the fuel pressure sensor 41 is output to the ECU 2.

In addition, the fuel supply device 1 includes a bypass pipe 17 which bypasses the high-pressure fuel pump 20. In the bypass pipe 17, a a relief valve 18 is disposed. The relief valve 18 is a mechanical valve, and limits the fuel pressure PF so as to not exceed a relief valve opening pressure PRF by opening at the time when the fuel pressure PF in the delivery pipe 16 reaches the predetermined relief valve opening pressure PRF (e.g., 22 Mpa) to release the fuel to the side of low-pressure fuel passage 14.

Figure 3:
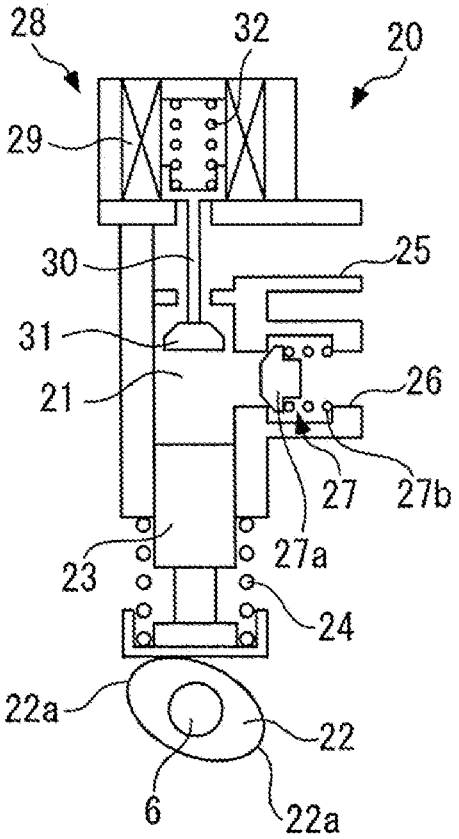
FIG. 3 is a schematic view illustrating a high-pressure fuel pump.

As shown in FIG. 3, the high-pressure fuel pump 20 includes a plunger 23 slidably disposed in a pressurizing chamber 21 and engaged with a pump driving cam 22, and a spring 24 that urges the plunger 23 toward the side of the pump driving cam 22. The pump driving cam 22 is integrally provided on an exhaust camshaft 6 of the engine 3. With the above configuration and that the pump driving cam 22 is provided with two cam ridges 22*a*, 22*a* equidistantly arranged in the circumferential direction, in each round of rotation of the exhaust camshaft 6, the plunger 23 reciprocates twice at an equal cycle in the pressurizing chamber 21.

In addition, in the high-pressure fuel pump 20, an inhalation port 25 and a discharge port 26 in communication with the pressurizing chamber 21 are formed. The inhalation port 25 is connected with the low-pressure fuel pump 12 via the low-pressure fuel passage 14, and the discharge port 26 is connected with the delivery pipe 16.

A check valve 27 is provided between the pressurizing chamber 21 and the discharge port 26. The check valve 27 is configured by a valve body 27*a* and a spring 27*b* urging the valve body 27*a* to the side of the pressurizing chamber 21. The check valve 27 opens and allows fuel to be discharged from the discharge port 26 when the pressure of the fuel in the pressurizing chamber 21 exceeds the fuel pressure PF of the delivery pipe 16, and is otherwise closed to prevent the fuel from flowing back to the pressurizing chamber 21.

In addition, a spill control valve 28 is provided between the pressurizing chamber 21 and the inhalation port 25. The spill control valve 28 is configured as a solenoid valve, and is formed by a solenoid 29, a plunger 30 having a valve body 31 at the tip and driven by the solenoid 29, and a spring 32 urging the plunger 30 toward the side of the pressurizing chamber 21, etc. The spill control valve 28 is of a constant-open type. When the solenoid 29 is not excited, the spill control valve 28 is maintained in an open state by the urging force of the spring 32, and the inhalation port 25 is opened. When the solenoid 29 is excited by being energized, the valve is closed, and the the inhalation port 25 is closed.

In the high-pressure fuel pump 20 with the above configuration, during the lowering of the plunger 23 by the pump driving cam 22 and the spring 24 (retracting from the pressurizing chamber 21), with the spill control valve 28 being controlled in the open state, the fuel is sucked into the pressurizing chamber 21 via the low-pressure fuel passage 14 and the inhalation port 25 from the side of the low-pressure fuel pump 12. Meanwhile, during the rising of the plunger 23, with the spill control valve 28 being energized to be closed, the fuel in the pressurizing chamber 21 is pressurized, and the pressure of the fuel rises. Then, when the pressure of the fuel in the pressurizing chamber 21 exceeds the fuel pressure PF of the delivery pipe 16, by opening the check valve 27, the fuel in the pressurizing chamber 21 is discharged to the delivery pipe 16 via the discharge port 26.

In addition, when the plunger 23 rises, in the case where the spill control valve 28 remains open until halfway and is then closed, the fuel in the pressurizing chamber 21 passes through the opened inhalation port 25 and flows back to the fuel tank 11 via the low-pressure fuel passage 14 and the fuel return path 15 until the spill control valve 28 is closed. In the following, the return of the flow of the fuel once sucked to the high-pressure fuel pump 20 to the low-pressure side is referred to as "spill". In addition, after the spill control valve 28 is closed, in response to the close timing thereof, at the time point when the pressure of the fuel in the pressurizing chamber 21 exceeds the fuel pressure PF of the delivery pipe 16, the fuel is discharged.

The close timing of the spill control valve 28 at the time when the plunger 23 rises is controlled by an energization duty ratio DTSC (the proportion of the energization period in the entire period) to the solenoid 29. Accordingly, a fuel discharge amount QFP to the delivery pipe 16 and the fuel pressure PF of the delivery pipe 16 are controlled.

For example, at the time when the energization duty ratio DTSC is 100%, the close timing of the spill control valve 28 is changed to be the earliest. As a result, the fuel discharge amount QFP becomes the maximum, and, correspondingly, the rising rate of the fuel pressure PF becomes the highest. Meanwhile, the smaller the energization duty ratio DTSC, the later the close timing of the spill control valve 28. As a result, the fuel discharge amount QFP and the rising rate of the fuel pressure PF become small.

In addition, in the crankshaft (not shown) of the engine 3, a crank angle sensor 42 is provided (as shown in FIG. 2). The crank angle sensor 42 outputs a CRK signal and a TDC signal, which are pulse signals, as the crankshaft rotates.

The CRK signal occurs at each predetermined crank angle (e.g., 30°). The ECU 2 calculates a rotation speed NE of the engine 3 (referred to as "engine rotation speed" in the following) based on the CRK signal. The TDC signal is a signal indicating that, in any of the cylinders 3*a*, a piston (not shown) of the engine 3 is in a vicinity of a top dead center (TDC) at the time when the intake stroke starts. In the embodiment, since the engine 3 has four cylinders 3*a*, the TDC signal occurs at each crank angle of 180°.

In addition, a detection signal indicating a water temperature TW of the cooling water of the engine 3 (referred to as "engine water temperature" in the following) is input from a water temperature sensor 43 to the ECU 2. In addition, a detection signal indicating an operation amount AP (referred to as "accelerator opening degree" in the following) of an accelerator pedal (not shown) of the vehicle is input from an accelerator opening sensor 44 to the ECU 2.

The ECU 2 is configured as a microcomputer (not shown) formed by a CPU, a RAM, a ROM, and an input/output interface (none of which is shown in the drawings). In response to the detection signals, etc., from the sensors 41 to 44, the ECU 2 determines the operation state of the engine 3 according to the control program stored in the ROM, and performs engine control including the control of the fuel injection by the injector 4 and the control of the ignition period by the ignition plug 5. Specifically, in the embodiment, the fuel pressure control which controls the fuel pressure P is performed via the high-pressure pump 20.

Figure 4:
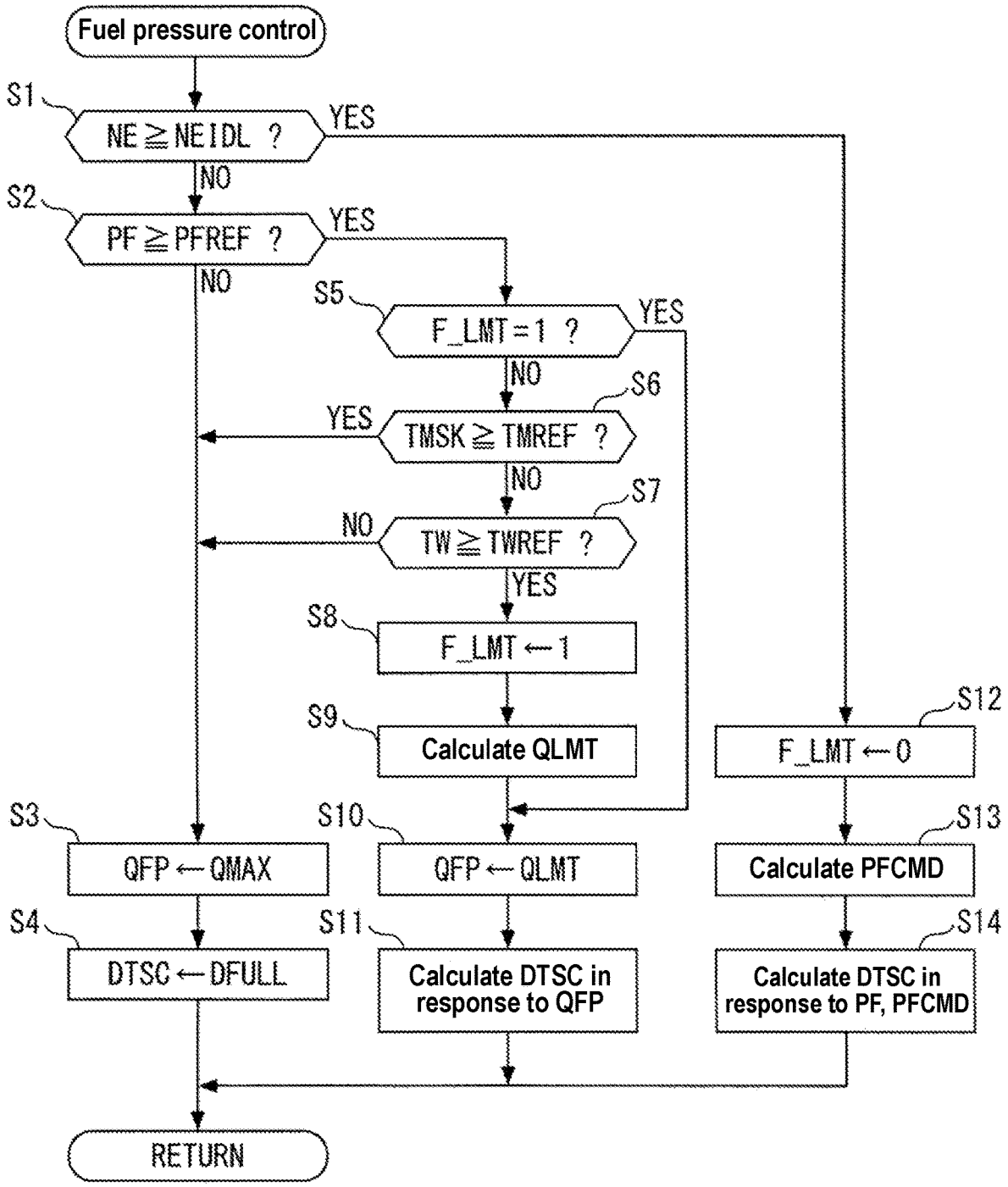
FIG. 4 is a flowchart illustrating a fuel pressure control process performed by an ECU.

FIG. 4 illustrates the fuel pressure control process. The process is synchronized with the occurrence of the CRK signal and repetitively performed from the time when of the startup of the engine 3 begins until the time of the normal operation during the operation of the engine 3. In the process, in Step 1 (shown as "S1"; the same applies in the following), whether the detected engine rotation speed NE is equal to or greater than a predetermined idle rotation speed NEIDL is determined.

With the result of Step 1 being NO, at the time when the engine rotation speed NE does not reach the idle rotation speed NEIDL, it is assumed that cranking is being performed and the process proceeds to Step 2 to determine whether the detected fuel pressure PF is equal to or greater than a predetermined threshold PFREF. The threshold PFREF is set to be in a vicinity of a target fuel pressure (e.g., 16 Mpa) at the time of startup. Specifically, the threshold PFREF is set to be a value obtained by subtracting a smaller predetermined value from the target fuel pressure PFCMD.

With the result of Step 2 being NO, at the time when the fuel pressure PF does not reach the threshold PFREF, boost control is performed. Specifically, the fuel discharge amount QFP of the high-pressure fuel pump 20 is set to be a predetermined maximum QMAX (Step 3), and, in order to realize the maximum QMAX, the energization duty ratio DISC of the spill control valve 28 is set to be a full spill value DFULL (=100%) (Step 4), and the process is ended. By setting the fuel discharge amount QFP and the energization duty ratio DISC in this way, in the boost control, the fuel pressure PF rises at the maximum rate.

Alternatively, with the result of Step 2 being YES, at the time when the fuel pressure PF reaches the threshold PFREF, whether a limit control flag F_LMT is "1" is determined (Step 5). In the case where the process proceeds to Step 5 for the first time, the result of Step 5 is NO, and Step 6 is performed correspondingly. In Step 6, whether a stop time TMSK (time from the previous stop time to the time when the current startup begins) is equal to or greater than a predetermined time TMREF (e.g., 8 hours) is determined.

With the result of Step 6 being YES, since it is estimated that the fuel pressure PF by the time of the current startup has dropped sufficiently when the stop time TMSK of the engine 3 is relatively long, the concern of the occurrence of an overshoot of the fuel pressure PF together with the startup does not arise. Therefore, Steps 3 and 4 are performed without performing the limit control to be described in the following, the fuel discharge amount QFP is set to be the maximum QMAX whereas the energization duty ratio DTSC is set to be the full spill value DFULL, and the process ends.

Alternatively, at the time when the result of Step 6 is NO, in Step 7, whether the detected engine water temperature TW is equal to or greater than a predetermined temperature TWREF. At the time when the answer is NO, it is estimated that the fuel pressure PF is in a state of being relatively low as the temperature of the fuel is low, so the concern of the occurrence of an overshoot of the fuel pressure PF together with the startup does not arise. Therefore, in this case, Step 3 and Step 4 are performed without performing the limit control of the fuel pressure PF, either.

Alternatively, at the time when the answer of Step 7 is YES, since the stop time TMSK of the engine 3 is short, and the temperature of the fuel is high, the fuel pressure PF is in a state of being relatively high. Therefore, the concern of the occurrence of an overshoot of the fuel pressure PF together with the startup arises. In order to avoid such occurrence, the limit control is performed since Step 8.

Specifically, in Step 8, in order to indicate that the limit control is being performed, the limit control flag F_LMT is set to "1". Then, an upper limit QLMT of the fuel discharge amount of the high-pressure pump 20 is calculated according to Formula (1) in the following:

$$QLMT=\Delta P\cdot V/K \quad (1),$$

wherein ΔP represents a fuel pressure variation amount, and is calculated as a difference between the relief valve opening pressure PRF and the fuel pressure PF (=PRF−PF), V represents the capacity of the delivery pipe 16, and K represents a bulk modulus of the fuel.

In addition, Formula (1) is one based on Formula (2) in the following as the relationship formula among liquid-related pressure, capacity, and volume, and is obtained by deriving Formula (3) which represents a fuel volume variation amount AQ of Formula (2) and replacing ΔQ with the upper limit QLMT of the fuel discharge amount.

$$\Delta P=(\Delta Q/V)\cdot K \quad (2),$$

wherein ΔQ represents the fuel volume variation amount.

$$\Delta Q=\Delta P\cdot V/K \quad (3)$$

Therefore, the upper limit QLMT calculated by using Formula (1) means a limit value of the fuel amount which each operation of the high-pressure fuel pump 20 is able to discharge from the current time point until the fuel pressure PF reaches the relief valve opening pressure PRF.

Referring to FIG. 4 again, in Step 10, the upper limit QLMT calculated in Step 9 is set as the fuel discharge amount QFP. Then, in Step 11, in response to the fuel discharge amount QFP, by searching in a predetermined map (not shown), the energization duty ratio DISC of the spill control valve 28 is calculated, and the process is ended.

In addition, after Step 8 is performed, the result of Step 3 becomes YES. In such case, by skipping Steps 6 to 9 and performing Steps 10 and 11, the fuel discharge amount QFP is set to be the upper limit QLMP, and the energization duty ratio DISC is calculated in response to the fuel discharge amount QFP.

Alternatively, at the time when the result of Step 1 is YES, and the engine rotation speed NE reaches the idle rotation speed NEIDL, cranking is completed, the engine 3 is started (complete explosion), the limit control flag F_LMT is reset to "0" (Step 12), and the limit control is ended and the process proceeds to normal control.

In the normal control, firstly, the target fuel pressure PFCMD is calculated (Step 13). The calculation of the target fuel pressure PFCMD is performed by searching in a predetermined map (not shown) in response to the engine rotation speed NE and a required torque TRQ, for example. In addition, the required torque TRQ is calculated by searching in a predetermined map (not shown) in response to the engine rotation speed NE and the detected accelerator opening degree AP.

Next, in Step 14, in response to the fuel pressure PF and the target fuel pressure PFCMD, through the feedback control so as to change the fuel pressure PF to the target fuel pressure PFCMD, the energization duty ratio DISC of the spill control valve 28 is calculated, and the process is ended.

Figure 5:
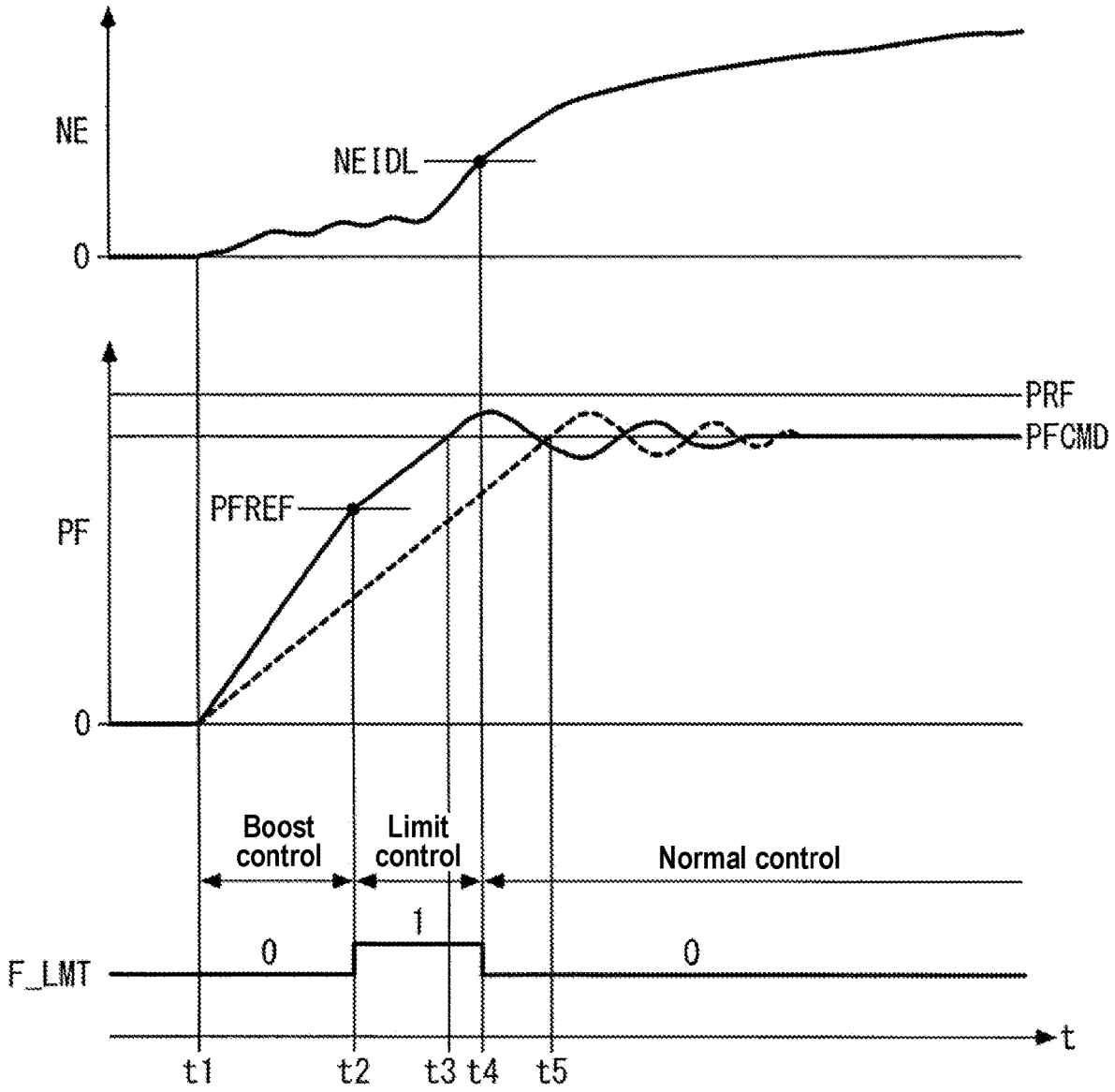
FIG. 5 is a diagram illustrating an operation example obtained by the fuel pressure control process of FIG. 4 and a comparative example.

FIG. 5 illustrates the operation example (solid line) obtained through the fuel pressure control process of FIG. 4 having been described so far and the comparative example (dotted line) together. The comparative example, as described in Patent Document 1, is one that limits the energization duty ratio of the spill control valve and the fuel discharge amount from the time when the startup of the internal combustion engine begins.

In the example, at the time point t1, the startup (cranking) begins. From the time when the startup begins until the fuel pressure PF reaches the threshold PFREF (time point t2), the result of Step 2 of FIG. 4 is NO, and the boost control of the fuel pressure PF is performed. In the boost control, by setting the fuel discharge amount QFP to the maximum QMAX (Step3) and setting the energization duty ratio DISC to the full spill value DFULL (Step 4), the fuel pressure PF rises drastically.

When the fuel pressure PF reaches the threshold PFREF (time point t2), the limit control flag F_LMT is set to "1" (Step 8), and the limit control of the fuel pressure PF starts. In the limit control, the fuel discharge amount QFP is limited by using the upper limit QLMT calculated by using Formula (1), and, in response to the limited fuel discharge amount QFP, the energization duty ratio DISC is calculated (Steps 9 to 11). According, the rising rate of the fuel pressure PF is decreased, and the fuel pressure PF reaches the target fuel pressure PFCMD at the time point t3. Together with this, by injecting fuel from the injector 4 and performing combustion, the engine rotation speed NE is further increased.

Then, when the engine rotation speed NE reaches the idle rotation speed NEIDL (time point t4), the engine 3 is started, and the limit control flag F_LMT is reset to "0" (Step 12), the limit control is ended, and the normal control of the fuel pressure PF starts. In the normal control, the energization duty ratio DISC is calculated through feedback control (Steps 13 to 14) so that the fuel pressure PF is changed to the target fuel pressure PFCMD set in response to the operation state of the engine 3.

Regarding this, in the comparative example, since the limitations on the energization duty ratio of the spill control valve and the fuel discharge amount are performed since the time when the startup of the engine begins, as indicated by the dotted line, the rising rate of the fuel pressure PF is suppressed. As a result, while an overshoot of the fuel pressure PF does not occur, the timing of reaching the target fuel pressure PFCMD is becomes late (time point t5), and the engine is started delayed.

Based on the above, according to the embodiment, during the startup of the engine 3, by performing the boost control of the fuel pressure PF from the time when cranking starts until the fuel pressure PF reaches the threshold PFREF slightly smaller than the target fuel pressure PFCMD, the energization duty ratio DISC of the spill control valve 28 is set to be the full spill value DFULL, and the fuel discharge amount QFP of the high-pressure pump 20 is controlled to be the maximum QMAX. Accordingly, the rising rate of the fuel pressure PF is controlled to be the maximum. Accordingly, with the fuel pressure PF quickly rising at the time when the cranking starts and reaching the target fuel pressure PFCMD at an early stage, the injection timing of the fuel from the injector 4 is advanced, and the startup of the engine 3 can thus be accelerated.

In addition, by performing the limit control following the boost control and limiting the fuel discharge amount QFP by using the upper limit QLMT, the rising rate of the fuel pressure PF is suppressed. Accordingly, an overshoot in which the fuel pressure PF significantly exceeds the target fuel pressure PFCMD to reach the relief valve opening pressure PRF can be avoided. As a result, together with the acceleration of the startup of the engine 3, a favorable startup ability can be ensured.

In addition, as shown in Formula (1), the upper limit QLMT limiting the fuel discharge amount QFP is set based on the relationship between the detected fuel pressure PF when proceeding to the limit control and the relief valve opening pressure PFR. Therefore, the upper limit QLMP can be appropriately set, so that the actual fuel pressure PF at this time point is reflected, while the fuel pressure PF does not exceed the relief valve opening pressure PRF.

Accordingly, the limitation on the fuel discharge amount QFP in the limit control can be appropriately carried out.

Moreover, when the engine rotation speed NE reaches the idle rotation speed NEIDL, it is estimated that the fuel has been injected from the injector 4, the concern about the overshoot of the fuel pressure PF does not arise, and the limit control is ended. Therefore, the fuel pressure PF can be prevented from being suppressed unnecessarily.

In addition, since the limit control is performed when the conditions that the stop time TMSK of the engine 3 is shorter than the predetermined time TMREF and that the engine water temperature TW is equal to or higher than the predetermined temperature TWREF are met, the limit control can be effectively performed only under the condition that the fuel pressure PF at the time when the startup of the engine 3 begins is high and an overshoot is prone to occurring.

The invention is not limited to the described embodiments, and can be carried out in various embodiments. For example, in the embodiment, the predetermined timing is set as the timing when, after the startup of the engine 3 begins, the fuel pressure PF reaches the threshold PFREF slightly smaller than the target fuel pressure PFCMD, and the boost control is switched to the limit control. The predetermined timing can be arbitrarily set as long as the startup of the engine 3 is accelerated and the overshoot of the fuel pressure is suppressed.

For example, it is possible to set the threshold PFREF to be a value equal to the target fuel pressure PFCMD or a value slightly greater than the target fuel pressure PFCMD. Or, as the predetermined timing, it is possible to adopt a timing after a predetermined period from the starting of the cranking of the engine 3.

In addition, in the embodiment, when the engine rotation speed NE reaches the idle rotation speed NEIDL after the cranking starts, the injection operation of the fuel from the injector 4 is started, and the limit control is ended. However, it may also be that the limit control is ended after a predetermined period from the starting of the cranking.

Moreover, in the embodiment, in the case where the stop time TMSK of the engine 3 is relatively short or in the case where the engine water temperature TW is relatively high, the fuel pressure PF is determined as in a high state at the time when the start-up of the engine 3 begins, and the limit control is performed. However, in place of these parameters, other suitable parameters that represent the state of the fuel pressure PF at the time when the startup begins, such as the outside air temperature and the temperature of lubricant or fuel, etc., may also be used.

In addition, while the high-pressure fuel pump 20 of the embodiment is of the type which includes the spill control valve 28 and controls the fuel discharge amount QFP by changing the energization duty ratio DISC of the spill control valve 28, the configuration thereof may be arbitrary as long as the fuel discharge amount can be changed. In addition, it is possible to appropriately change the detailed configuration within the scope of the gist of the invention.

What is claimed is:

1. A fuel pressure control device for an internal combustion engine, wherein the fuel pressure control device controls a pressure of fuel supplied to a fuel injection valve, and the fuel pressure control device comprises:

a fuel pump, adopting the internal combustion engine as a driving source, and discharging pressurized fuel to a side of the fuel injection valve;

a boost control part, performing boost control of setting a fuel discharge amount of the fuel pump to a predetermined value for boosting the pressure of the fuel from a time when cranking starts until a predetermined timing halfway during a startup of the internal combustion engine;

a limit control part, performing limit control following the boost control, wherein the limit control limits the fuel discharge amount by using an upper limit smaller than the predetermined value; and a pressure state determination part, determining a state of the pressure of the fuel that is synchronized with an occurrence of a signal output from a crank angle sensor and repetitively performed from a time when the startup of the internal combustion engine begins until a time of a normal operation during an operation of the internal combustion engine.

2. The fuel pressure control device for the internal combustion engine as claimed in claim 1, wherein a target fuel pressure is set as a target value of the pressure of the fuel necessary for injecting the fuel from the fuel injection valve, and the fuel pressure control device further comprises a fuel pressure detection part which detects the pressure of the fuel, and the predetermining timing is a timing at which the pressure of the fuel that is detected reaches a vicinity of the target fuel pressure.

3. The fuel pressure control device for the internal combustion engine as claimed in claim 1, further comprising:

a relief valve, opening at a time when the pressure of the fuel reaches a predetermined relief valve opening pressure to release the pressure of the fuel; and an upper limit setting part, setting the upper limit based on a relationship between the pressure of the fuel detected at the predetermined timing and the relief valve opening pressure.

4. The fuel pressure control device for the internal combustion engine as claimed in claim 1, further comprising:

a rotation speed detection part, detecting a rotation speed of the internal combustion engine, wherein the limit control part ends the limit control at a time when the rotation speed of the internal combustion engine that is detected reaches a predetermined rotation speed or after a predetermined period from a time when the startup of the internal combustion engine begins.

5. The fuel pressure control device for the internal combustion engine as claimed in claim 1, wherein the limit control part performs the limit control under a condition that the pressure of the fuel is determined as being in a high state.

* * * * *